US006324811B1

(12) United States Patent
Gauss et al.

(10) Patent No.: US 6,324,811 B1
(45) Date of Patent: Dec. 4, 2001

(54) COVERING AN INTERIOR SURFACE

(76) Inventors: Jane S. Gauss, 68 Chadbourne Dr., Hudson, OH (US) 44236; Liza M. Glenn, 31732 Fourth Ave., Laguna Beach, CA (US) 92677

( * ) Notice: Subject to any disclaimer, the term of this patent is extended or adjusted under 35 U.S.C. 154(b) by 0 days.

(21) Appl. No.: 09/440,346

(22) Filed: Nov. 15, 1999

Related U.S. Application Data

(60) Provisional application No. 60/127,103, filed on Mar. 31, 1999.

(51) Int. Cl.[7] ..... B44C 1/00

(52) U.S. Cl. ..... 52/746.12; 52/748.1; 52/506.01; 52/311.1; 156/63; 428/350; 428/914

(58) Field of Search ..... 52/311.1, 311.2, 52/506.01, 746.1, 746.12, 748.1; 156/61, 63, 71; 428/346, 350, 351, 355, 39, 904.4, 914, 77, 78

(56) References Cited

FOREIGN PATENT DOCUMENTS

2290305 * 9/2000 (CA) .

OTHER PUBLICATIONS

Classic Cutups; revival of 'cut and paste' decorative art brings easy way to enliven home. Article from The Gazette (Montreal) 2 pages, Mar. 1994.*

3 pages from www.christopherlowell.com titled Paper Bag Walls copyright 1999, Feb. 2001.*

1 page from www.homestore.com decorating folder showing Wallpaper:Special Effects using torn paper, Mar. 1994.*

The Associated Press, Headline: Show houses suggest ways to fix flaws– as in, paper them over, by Babara Mayer, Mar. 1994.*

The Fort Worth Star–Telegram, Headline: The Cinderalla Touch, Byline: Gaile Robinson, Apr. 1997.*

Calgary Herald, Section: Home Style; F2, Headline: Decoupage a simple, fun way to create art, Byline: Maureen DePatie, Jan. 1999.*

The Kansas City Star, Section:FY1, Headline: A real cutup, Byline: Dru Sefton, Jan. 1999.*

The Detroit News, Section: Homestyle, p. C13, Headline: By hand: Decoupage applies touch of class to ordinary objects, Byline: Carol Endler Sterbenz, Mar. 1997.*

The Times, Section: Features, Headline: Read all about it–on the wall, Byline: Lois Letts, Jan. 1997.*

The Toronto Star Section FYI Sunday Mar. 20, 1994 Decoupage dazzles walls, furniture.*

* cited by examiner

*Primary Examiner*—Robert Canfield

(74) *Attorney, Agent, or Firm*—Emerson R Skeriotis; Roger D. Emerson; Kimberly A. Raines

(57) ABSTRACT

Method and apparatus for interior decorating an extended-area surface in which a lightweight non-fabric sheet stock is permanently preprinted and sealed on its entire outwardly-disposed surface, and coated on its inwardly-disposed surface with a dry prepaste capable of being activated by moistening with water. Hand-torn pieces are wetted and applied with ragged hand-torn edges overlapping which, as dried, are seam-free to sight or touch. Wall papering can be carried out without matching patterns or concern with plumb lines.

27 Claims, 5 Drawing Sheets

COVERING AN INTERIOR SURFACE

RELATED APPLICATION

This application claims the benefit of U.S. Provisional Application Ser. No. 60/127,103, filed Mar. 31, 1999.

INTRODUCTION

This invention relates to handcraft methods, products and apparatus for interior decorating; and, in particular, is concerned with efficiently covering a two-dimensional interior surface.

OBJECTIVES OF THE INVENTION

One objective is to enable a novice at wallpapering to cover, by hand, walls or other surfaces to provide a personal decor for an interior room.

Another objective is to provide handcraft techniques which facilitate effective and efficient covering of extended-area interior surfaces.

A further objective is eliminating use of paints or stains, or any requirement for fine art skills during interior surface decorating.

An added objective is to provide handcraft techniques for ease of wall papering an interior room while enabling selective completing in stages.

Other objectives and advantages of the invention are described in more detail with references to the accompanying drawings.

DETAILED DESCRIPTION OF THE DRAWINGS

Figure 1:
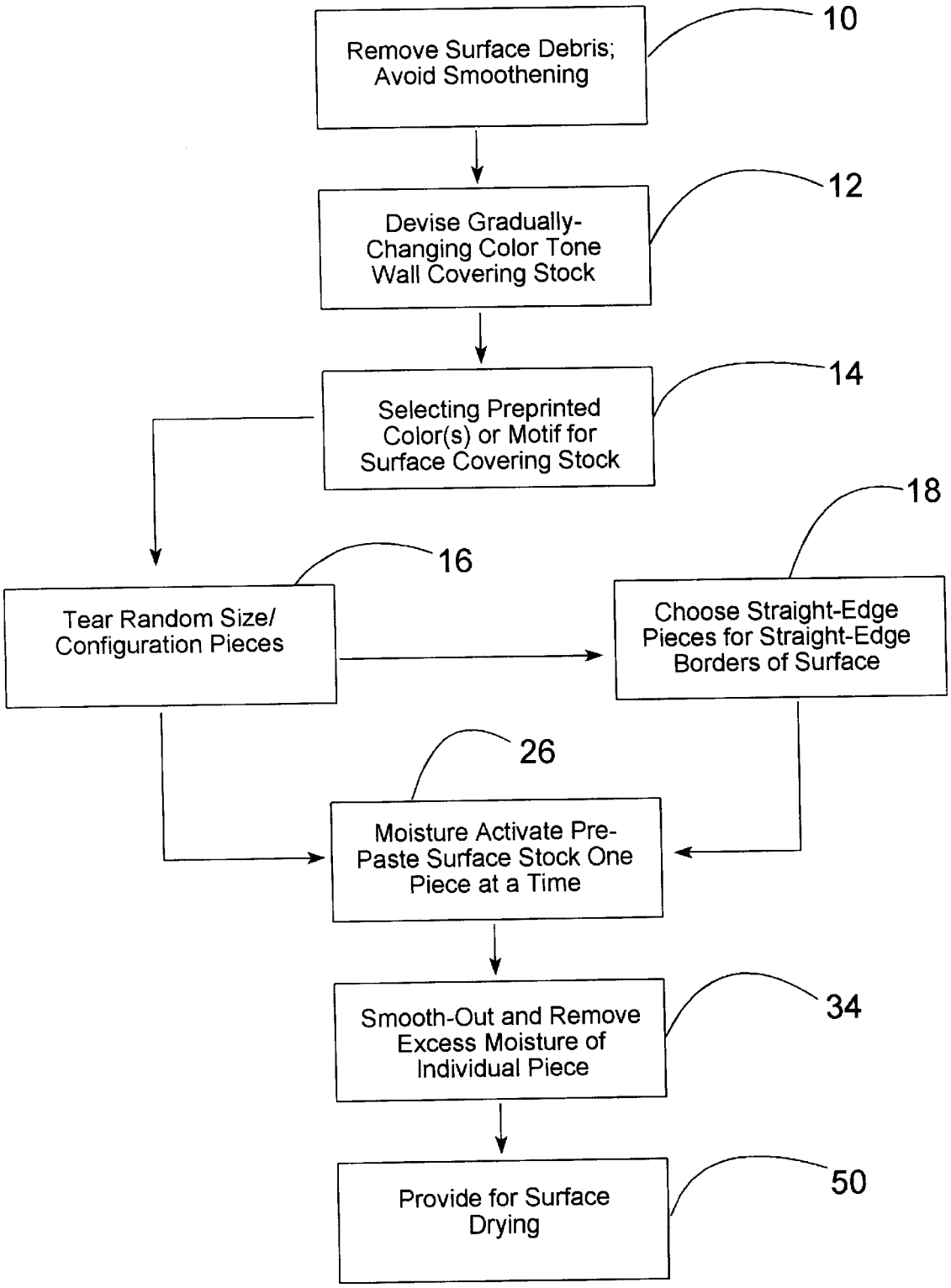
FIG. 1 is a flow-chart presentation for describing surface-covering steps of the invention.

During interior wall surface preparation at stage 10 of FIG. 1, loose surface debris is removed, along with any remaining earlier surface covering(s) likely to inhibit adhesion of the present paper substrate product.

However, slightly irregular, or uneven, surfaces are not removed, and such surfaces can contribute to a personal finish appearance without disturbing adhesion of the sheet stock of the invention. That is, apparently defective slightly non-planar or non-symmetrically curved surfaces, as undisturbed, can be readily decorated by the present handcraft methods without any sign of defect.

The invention relies on sheet stock, which presents a pair of opposed surfaces when in a flat configuration, for efficiently creating a specialized personal decor in a room.

In accordance with the invention, a lightweight wallpaper sheet stock, capable of being hand-torn in random shapes and sizes, is utilized. One full sheet stock surface, which is to be exposed when used as covering, is permanently preprinted at stage 12 of FIG. 1 with a selected presentation. Such preprinted surface is permanent and sealed so as to avoid running or disturbing of the selected presentation during later moisture-activation of a dry prepaste on the subsurface, which is inwardly disposed during application of the sheet stock product.

A latex binder and water insoluble pigment(s) are used; in that way the surface to be exposed is sealed without detriment to overlapping edge adhesion. Conventional wallpaper sealing polymers, such as vinyl, which could inhibit overlapping-edge adhesion of the invention, are eliminated.

Gradations of color(s), monochromatic tones, or a motif, for example, ancient maps or early daguerreotype reproductions, etc., can be selected, as indicated at stage 14 of FIG. 1, to cover the entire exposed surface. Colors associated with structural stone can also be selected for creating a faux-finish of stone for an interior wall.

Such non-fabric lightweight sheet paper stock, capable of being hand-torn as selected for the handcrafting, can be provided, preferably, in continuous sheet rolls of about one hundred (100) square feet. The sheet stock is incrementally unwound into a flat configuration in portions selected for direct use.

Pieces of random sizes and shapes are hand-torn, as indicated at station 16, with at least a portion of the periphery presenting a hand-torn ragged-edge. Such overlapping ragged-edges contribute to a seam-free appearance by using surface finishing techniques of the invention.

Planar cross-dimensional sizes of about eight to twelve inches, or as convenient for personal handling, are torn. Pieces with a straight-edge peripheral portion are selected as indicated at station 18 of the flow-chart of FIG. 1, for starting surface application.

The process relies on overlapping of hand-torn peripheral ragged edges of contiguous pieces. Relatively large hand-torn sizes have advantages during installation; smaller pieces can be hand-torn for filling in remaining open areas. Such starter straight-edge pieces (station 18) are selected for application at straight-edge locations, such as along ceiling molding of a wall surface.

Figure 2:
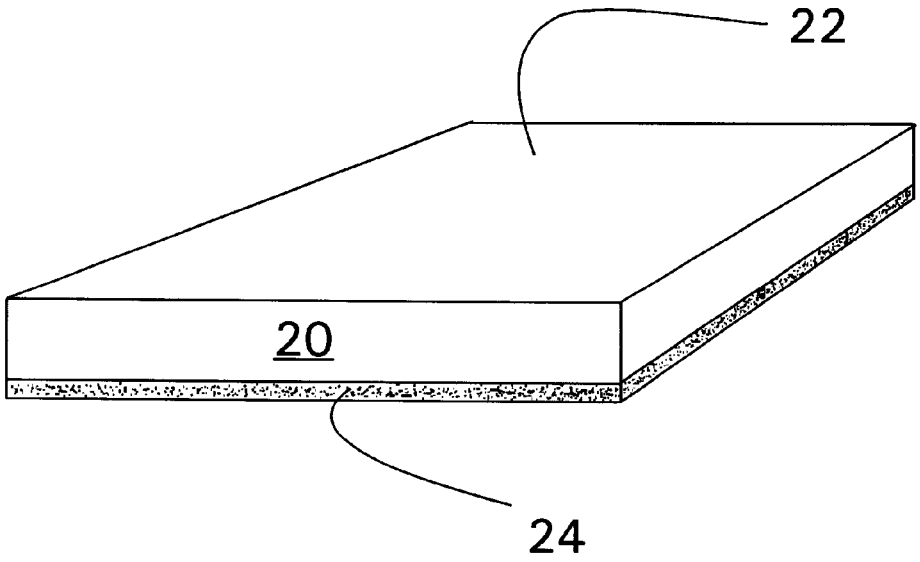
FIG. 2 is an enlarged perspective view, with portions shown in cross section, of sheet stock of the invention.

Referring to the enlarged cross-sectional view of FIG. 2, paper substrate 20 is permanently preprinted on the entire surface area to be exposed. Pigment materials, which are insoluble in water, can be blended with an unsaturated ester, or a latex binder, along with a filler, to produce a preprinted sealer (22, FIG. 2). Such surface is prepared to avoid being disturbed by later remoisturizing of the dry prepaste (24 FIG. 2) on the sheet stock subsurface.

Dry prepaste coating 24 covers the entire subsurface of the sheet stock. An integral dry prepaste is preferably -activated for adherence to a surface to be covered. A readily remoisturized subsurface paste significantly enhances ease of handling, by a beginner, for decorating an interior wall or other surface.

In a specific embodiment of the invention, sheet stock weight, combining substrate 20, preprinting 22, and prepaste 24 is about point five (0.5) to about point seventy-five (0.75) ounce per square foot. Remoisturizing such dry prepaste is carried out at stage 26 of the flowchart of FIG. 1. Such moisture activating is carried out by dipping an individual hand-torn piece, such as 28 of FIG. 3, into an activated liquid 30 (such as water) in trough 32, as shown in FIG. 4; followed by application, starting as shown in FIG. 5, and with peripheral ragged-edge portions of contiguous pieces overlapping.

Several burdensome steps required by conventional wallpapering are eliminated by the handcraft installation techniques of the invention. Moisture-activated hand-torn pieces of convenient size are readily applied one-at-a-time, with peripheral ragged edges overlapping. Use of plumb lines for marking walls, and matching of patterns along a wall are eliminated. The process, as taught herein, can be interrupted by ceasing remoisturizing of a further piece and can be restarted, as convenient, without deadlines.

Figure 3:
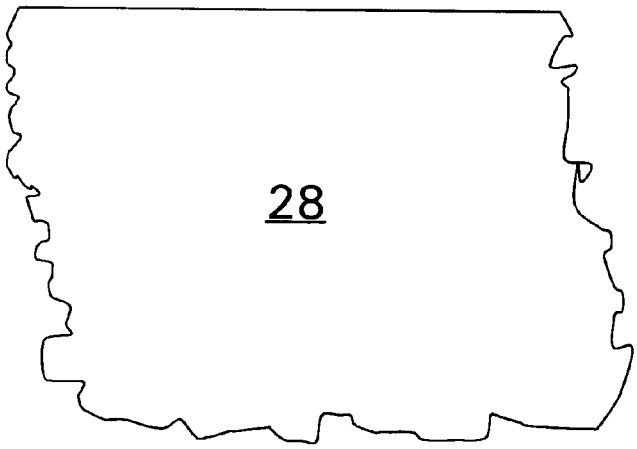
FIG. 3 is a schematic plan view of sheet stock product of the invention with a straight edge peripheral portion.
Figure 4:
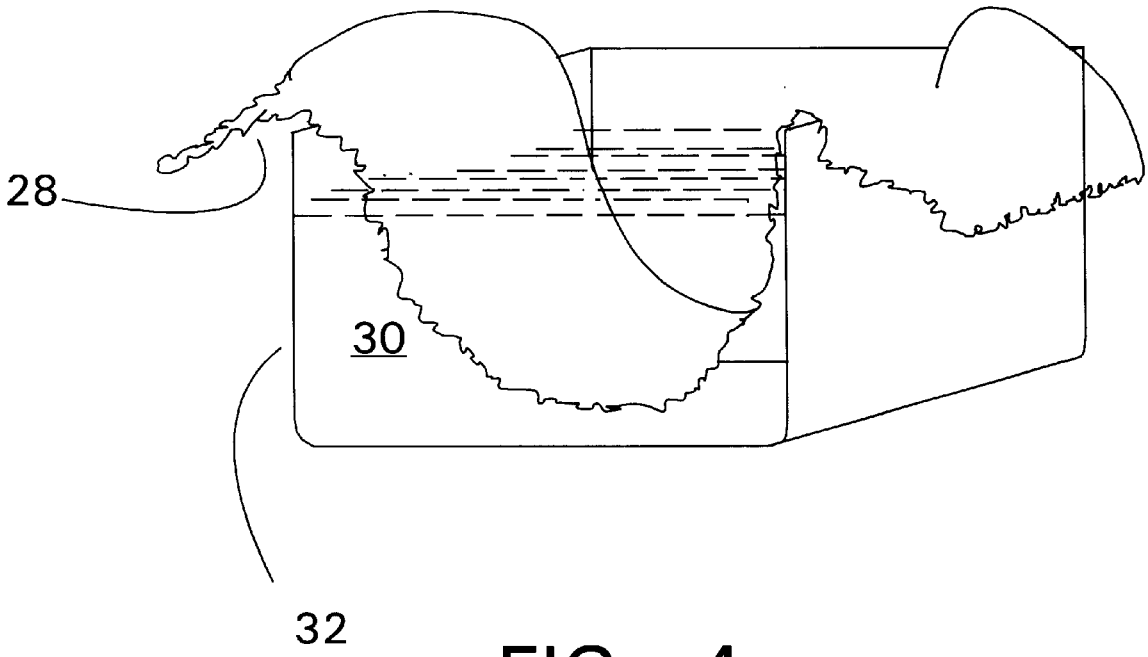
FIG. 4 is a schematic view, in elevational cross section, of product and structure for describing a sheet stock preparation step of the invention.
Figure 5:
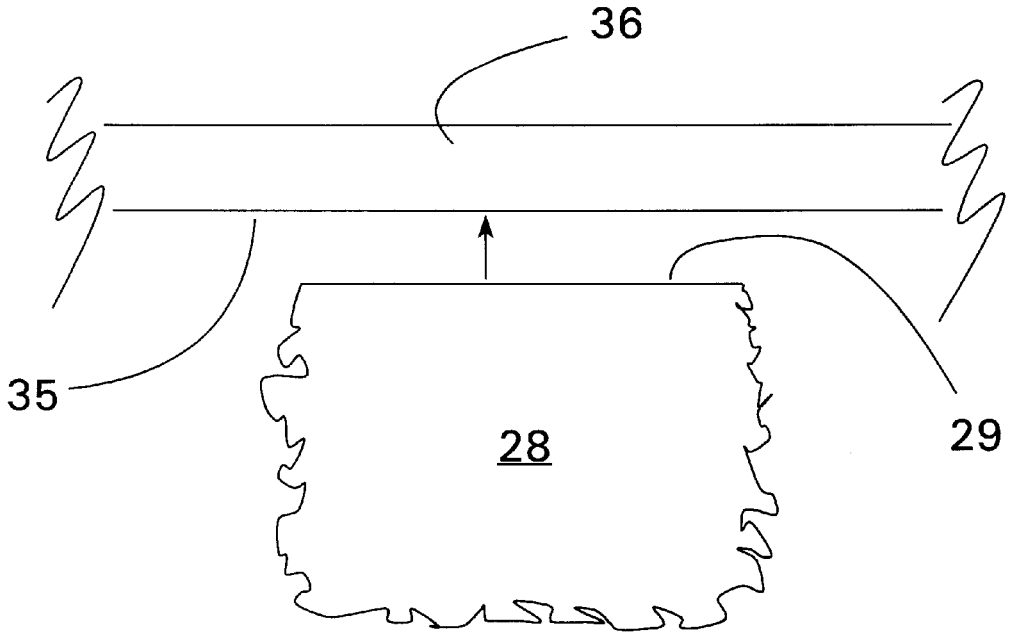
FIG. 5 is a schematic partial view in elevation, for describing method steps of the invention, for positioning and applying a straight-edge peripheral portion of such sheet stock.

A straight-edge piece, such as 28 of FIG. 3, is selected for starter positioning and application, as shown in FIG. 5. Positioning of such a moisture-activated handtorn piece is initiated, with its straight edge 29 along a straight line of the room. Then, as indicated by stage 34 of FIG. 1, excess moisture is removed from such piece using the tooling of FIGS. 6 and 7, moving toward peripheral ragged-edges.

Such a straight-edge (29) of moisture-activated piece (28) is applied along a straight edge of a wall surface; for example, straight-edge 35 of crown molding 36 (FIG. 5). Straight-edge interior wall lines are presented by, for example, crown molding, chair molding, baseboard molding, window or door molding, or by cupboard or shelving framework which projects from a wall surface.

Figure 6:
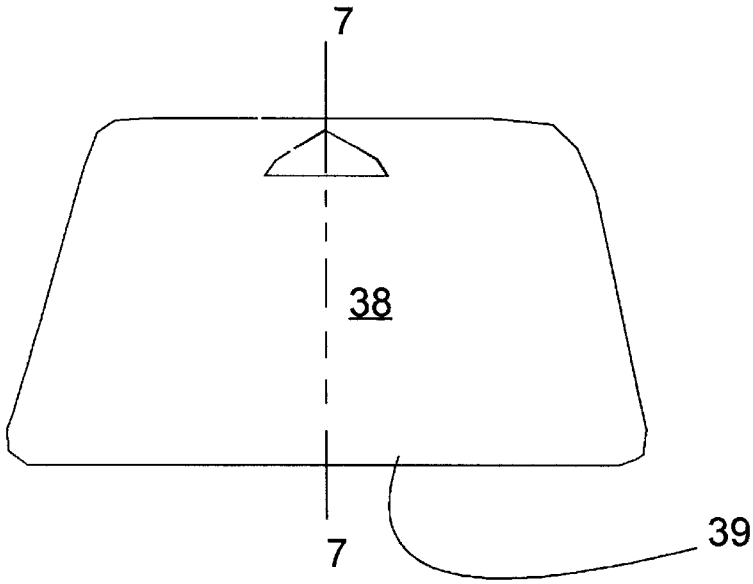
FIG. 6 is a schematic plan view for describing tooling configuration provided for carrying out designated method steps of the invention.
Figure 7:
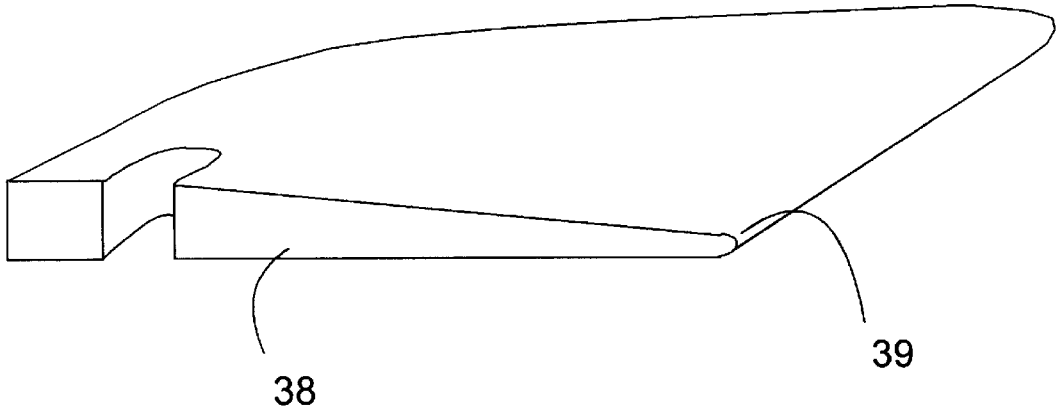
FIG. 7 is a schematic cross-sectional view of the tooling FIG. 6, taken along the line 7-7.

Corner application and practice for interior wall covering is implemented by tooling 38 of FIGS. 6, 7. The configuration of such tooling contributes to ease of handling and use; a lightweight rigid plastic material with rounded edges prevents rupturing of a remoisturized piece.

Rounded-edge portion 39 of tooling 38 is used, for example, for placing the straight-edge peripheral portion 29 of piece 28 along straight edge 35 of crown molding 36 in FIG. 5; and, also, in special ways during corner installations. Rounded-edge 39 is also used during installation practice for removal of excess moisture, as individual hand-torn pieces are made smooth by such tooling during application.

Figure 8:
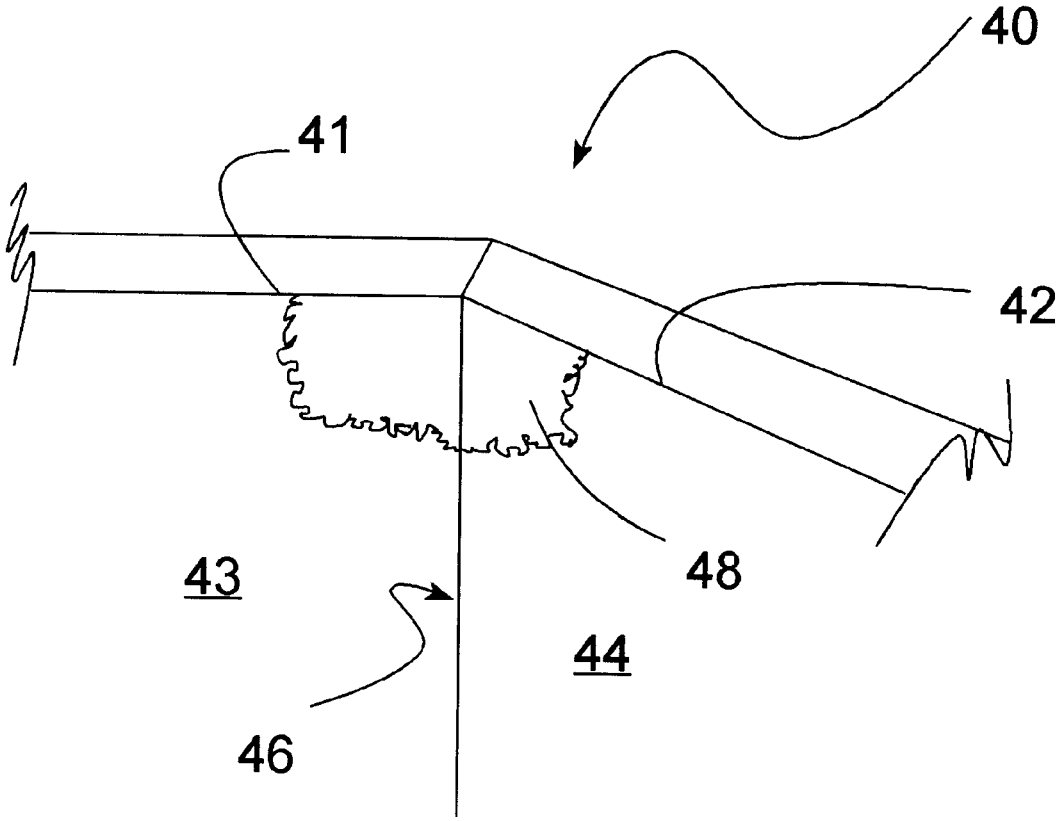
FIG. 8 is a schematic perspective partial view for describing corner covering method steps of the invention.

In FIG. 8, corner crown molding 40 includes straight edges 41, 42 which meet at an interior corner formed by the intersection of walls 43, 44; such intersection forms upright corner line 46.

A centrally-located portion of piece 48 is pressed into that interior-angle corner, along line 46, by use of round edge 39 of tooling 38. After positioning such central portion of piece 48 along straight line 46, such rounded edge 39 and tooling 38 are used to remove excess moisture from the remaining portions of corner piece 48, by: working downwardly from molding edges 41, 42, and from the center line 46 toward each ragged-edge, along each such wall surface 43, 44.

Added hand-torn pieces with remoisturized dry prepaste 24 are subsequently placed with torn ragged edges overlapping previously-applied ragged edges by about one-fourth inch to about one-half inch. Such procedure, after overlapping of the hand-torn pieces, produces substantially seam-free adhesion of the ragged-edge substrate along such overlapping edges. Excess moisture of an individual piece is first directed toward its peripheral edge(s).

After removal of excess moisture with tool 38 toward such peripheral edges, the pieces are wiped with a wet sponge. Such overlapping-edge application continues, with removal of excess water, and wet sponge wiping being carefully carried out so as to avoid disturbing of any overlapping edges.

Dry prepaste 24 comprises a remoistenable adhesive. Applying such dry prepaste during a manufacturing stage facilitates the handcraft features of the invention. Preferably, a dry adhesive derived from an aqueous emulsion of synthetic polymer solids, monomers, and surfactants, which can then be activated by water, is applied to the subsurface. The lightweight wallpaper sheet stock, with preprinted seal and dry prepaste coating, of a specific embodiment of the invention can have a weight of about point five (0.5) to about point seventy-five (0.75) ounce per square foot.

Drying of applied pieces and prepaste of the present invention, at stage 50 of FIG. 1, can include at least partial control of humidity so as to allow earlier use of a space; however, more importantly, freezing of the water for remoisturizing of the dry prepaste should be avoided.

Practice of present handcraft techniques eliminates need for any use of paints or stains, or fine art work for establishing a personal decor, as described above.

Other advantages of the above handcraft techniques are (i) elimination of any concern with left or right pattern matching, (ii) minimized waste, (iii) minimized trimming where a fixture piece extends onto a surface, (iv) extended-length edges need not be matched, and (v) there is no need for concern with plumb lines.

The disclosed method blends hand-torn pieces of sheet stock together; individual pieces, positioned as described in edge-overlapping relationship, upon drying are substantially seam-free to the touch on a wall or other surface. Wetting integral dry prepaste with water, as shown, provides for ease of application; and, also, provides for ease of cleanup.

The present process saves surface preparation time by hiding surface imperfections; slightly uneven wall surfaces, and non-straight corner lines are not apparent when using the described pieces and procedures.

Wall surface footage requirements are readily calculated. Extra square footage of the sheet stock should be provided to enable covering accessories, switch-plate covers, pictures frames, or selected interior surfaces, such as cocktail table surfaces.

Selecting straight-edge pieces for use, as described above, eliminates most, if not all, trimming of the sheet stock.

All portions of a piece should be immersed for wetting the dry prepaste. It is preferred for ease of handling to wet one piece at a time and make application of that piece. Removing of excess water is preferably started near the center of a piece, moving outwardly to peripheral torn edges. Gently wiping with a slightly moistened sponge helps to finish application.

Present handcraft techniques can be easily started and stopped, thus covering of extended-area surfaces can be interrupted and restarted to suit the convenience of the user.

For covering an outside corner, as projecting into a room, a centrally-located portion of a torn piece is placed at the projecting corner; then, a tool (38) (FIGS. 6, 7) is used to smooth each surface; no trimming is necessary. However, should trimming be necessary, for example, around a light switch, a trimming knife is used before the applied piece dries.

Specific materials, steps, dimensions and procedures have been set forth for purposes of describing the invention; however, in the light of the above disclosure, selections other than those specified can be made without departing from the scope of patentable subject matter disclosed;

therefore, in determining the scope of protection, reference is required to the appended claims in combination with the above disclosure.

What is claimed is:

1. Handcraft process for interior decorating an extended-surface area, combining the steps of:

(A) providing a lightweight non-fabric surface-covering sheet stock which is capable of being hand-torn and, in flat configuration, presents a pair of opposed surfaces, with (i) one surface of such pair, which is to be exposed on such surface area, being permanently preprinted over its entire surface, with a pattern selected from the group consisting of:

(a) a chromatic presentation, (b) a randomly-presented motif, and (c) combinations thereof; with (ii) the remaining surface of such pair being integrally-precoated over its entire surface with dry prepaste capable of being moisture-activated without disturbing such preprinted surface;

(B) hand tearing randomly-shaped pieces of various sizes from such flat sheet stock so as to establish a hand-torn peripheral ragged-edge portion for each, (C) selecting an individual hand-torn piece, (D) moisture-activating such integral prepaste on such selected hand-torn piece so as to enable adhesion to a surface area to be covered; then (E) applying, by means of such moisture-activated prepaste, such selected hand-torn piece at a selected location of such surface area to be covered, and smoothing such initially-applied piece to the contour of such selected location of surface being covered;

(F) subsequently:

(i) selecting another piece with a handtorn peripheral ragged-edge portion, (ii) similarly moisture-activating such integral prepaste of such selected another hand-torn piece, (ii) positioning such another hand-torn piece with at least a portion of its hand-torn peripheral edge being in overlapping relationship with at least a portion of such hand-torn peripheral edge portion of such earlier applied piece, (iii) similarly, smoothing such subsequently-applied hand-torn piece to such surface being covered, with (iv) such smoothing being carried out to avoid disturbing such peripherally-overlapping handtorn edges; and (G) providing for surface drying of such applied sheet stock.

2. The process of claim 1, further including (H) placing individual moisture-activated handtorn pieces, one-at-a-time, with at least a portion of each peripheral hand-torn edge in edge-overlapping relationship with at least a portion of such hand-torn peripheral edge of at least one of such previously-applied hand-torn pieces; with (i) smoothing of each such subsequent individual piece being carried out so as to (ii) complete covering at least a portion of such extended-surface area being decorated.

3. The process of claim 2, in which water is used for moisture-activating such integral prepaste, and further including:

(I) similarly, (i) applying such moisture-activated handtorn pieces, with at least a peripheral edge portion in overlapping relationship with a hand-torn peripheral edge portion of at least one previously applied piece, and (ii) carrying out such smoothing to remove excess water from such individual hand-torn pieces, during (iii) covering of such area being decorated.

4. The process of claim 3, including, subsequent to such step of removing excess moisture, (J) damp wiping of such individually-applied randomly-shaped torn pieces while avoiding disturbing such peripherally-located overlapping torn edges.

5. Non-fabric wall covering sheet stock presenting, when in flat configuration, (i) a pair of opposed surfaces, with (ii) weight in the range of about 90.5 to about 0.75 ounce per square foot, as produced with (iii) permanently printed and sealed surface which is to be exposed during carrying out of the process of claim 1.

6. The process of claim 3, including selecting a permanently preprinted chromatic pattern selected from the group consisting of:

(i) monochromatic, and (ii) multiple colors.

7. The process of claim 6, including applying such randomly-shaped hand-torn pieces in such edge-overlapping relationship to establish a faux-finish for such area to be covered.

8. The process of claim 6, including selecting a matte-finish for such preprinted surface.

9. The process of claim 6, including selecting a water-activated dry prepaste for such remaining surface of such sheet material.

10. The process of claim 1, including selecting an interior wall of a room to be covered, with wall surfaces being selected from the group consisting of (i) substantially planar, (ii) curvilinear, and (iii) combinations of such contours of (i) and (ii).

11. The process of claim 10, in which a pair of such interior wall surfaces intersect forming a corner selected from the group consisting of:

(i) an included-angle interior-corner having an apex formed by such intersecting pair of wall surfaces which open from such apex into such room, and (ii) an exterior apex corner formed from intersecting wall surfaces which protrude into such room, and including the steps of (K) positioning a hand-torn randomly-shaped piece with a centrally-located portion in contact with such a selected corner apex, and then (L) smoothing remaining portions of such handtorn piece from such centrally-located portion toward such peripheral edges, so as to at least partially cover each of such pair of intersecting wall surfaces forming such corner.

12. The process of claim 10, including (M) selecting an interior wall which is interrupted by linearly-extended substantially straight-edge framing, selected from the group consisting of:

(i) chair molding, (ii) crown molding, (iii) window molding, (iv) door molding, (v) built-in structure molding, and (vi) combinations thereof; and further including:

(N) selecting a randomly-shaped piece of sheet material having a non-torn straight edge, and aligning such straight edge of such randomly-shaped moisture-activated piece in contact with such selected linearly-extended straight-edge framing on such interior wall being decorated.

13. Non-fabric lightweight surface-covering interior decorating sheet stock which, in flat configuration, presents:

a pair of opposed surfaces of a non-fabric substrate having a weight, as precoated, of about 0.5 to about 0.75 ounce per square foot, with (a) one of such pair of sheet stock surfaces being sealed over its entire area, which is exposed during such interior decora ting, by a permanently preprinted pattern, with (b) the remaining surf ace of such pair having an integral dry prepaste coating capable of being moisture-activated in preparation for adhesion of such sheet stock to an area to be decorated;

(c) such non-fabric sheet stock being:

(i) capable of being hand-torn into individual randomly-shaped and sized pieces, with at least a peripheral portion of such piece presenting a hand-torn ragged-edge, with (ii) an individual piece being applied, subsequent to moisture activation of such prepaste coating, to a surface to be decorated, in which (d) a hand-torn peripheral ragged-edge portion of a subsequently-applied piece overlaps a peripheral hand-torn ragged edge of at least one previously-applied piece, which (e) enables applying such hand-torn pieces in such overlapping edge manner, free of plumb line orientation and pattern matching, on such surface being decorated.

14. Handcraft process for decorating an interior wall, comprising:

(A) providing a non-fabric lightweight wall covering sheet stock presenting a pair of opposed surfaces, when in flat configuration, manufactured with (i) one of such pair of surfaces, permanently preprinted so as to seal such entire surface, by selecting such preprinting from the group consisting of (a) a chromatic presentation, (b) a randomly-presented motif, and (c) combinations of (a) and (b);

(ii) coating the remaining surface of such pair with an integral dry prepaste capable of being moisture-activated, for adhesion to an interior wall, without disturbing such preprinted surface;

(B) providing hand-torn randomly-shaped and sized pieces from such sheet material, with each to present at least a ragged-edge peripheral portion as hand torn;

(C) moisture-activating such prepaste coating on such remaining surface of individual randomly-shaped and sized hand-torn pieces;

(D) initially selecting a moisture-activated individual piece having a straight-edge portion and applying to a selected straight-edge location on such interior wall to be covered;

(E) removing excess moisture from an applied individual piece with a smoothing tool formed to avoid damage to a moisture-activated piece, during its application;

(F) subsequently:

(i) moisture-activating another individual hand-torn randomly-shaped and sized piece, with a ragged edge peripheral portion, (ii) applying such additional hand-torn piece to such surface with at least a portion of such peripheral hand-torn ragged-edge overlapping at least a portion of a hand-torn ragged-edge portion of at least one of such initially-applied pieces, and (G) selectively applying, in like manner, individual randomly-shaped and sized hand-torn pieces of such sheet stock with a peripheral torn-edge portion in overlapping relationship with a hand-torn peripheral edge portion of at least one previously-applied hand-torn piece.

15. The process of claim 14, including (A) selecting a wall surface and removing debris likely to inhibit adhesion, and (B) applying such randomly hand-torn pieces to such interior wall surface, including (i) initially removing excess activating moisture from each such hand-torn piece, as applied, (ii) damp wiping each such individual piece in such random pattern, as applied, with such steps (i) and (ii) above being carried out free of disturbing a peripheral overlapping edge of such pieces; and (C) providing for drying such wall covering in a manner which inhibits freezing of such activating moisture.

16. The process of claim 14, including selecting a matte-finish for such preprinted-surface of such sheet stock;

selecting a chromatic presentation for such permanently preprinted surface which has a gradually-changing monotone, and selecting a prepaste coating for such remaining surface of such sheet which is water-activated.

17. The process of claim 14, including providing a chromatic presentation for such preprinted surface, which represents a selected structural stone, placing such hand-torn pieces to establish a faux-finish stone structure on such wall being decorated.

18. Handcraft process for interior decorating an extended-surface area, comprising the steps of:

(A) providing torn pieces of sheet stock, said pieces having a pair of opposed surfaces, said pair of opposed surfaces comprising:

(i) one surface of such pair, which is to be exposed on said extended surface, having a preprinted pattern;

(ii) the remaining surface of such pair being precoated with a dry prepaste, capable of being moisture-activated without disturbing said preprinted pattern;

(B) selecting a first torn piece;

(C) moisture activating said prepaste on said first torn piece;

(D) placing said first torn piece at a selected location on said extended-surface area;

(E) selecting a second torn piece;

(F) moisture activating said prepaste on said second torn piece; and, (G) placing an edge portion of said second torn piece over at least a portion of said first torn piece.

19. The process of claim 18 further including the step of:

(H) placing individual moisture-activated torn pieces on said extended surface area, one-at-a-time, with at least a portion of each edge of each said torn piece overlapping at least one of said previously applied torn pieces.

20. The process of claim 19 further including the step of:

(I) smoothing each subsequent individual torn piece.

21. The process of claim 20, further including the steps of:

(J) using water to activate said prepaste; and, (K) carrying out said smoothing to remove excess water.

22. The process of claim 18, wherein said preprinted pattern is selected from the group consisting of:.

(1) a chromatic presentation, (2) a randomly-presented motif, and (3) combinations of 1 and 2.

23. The process of claim 19 further including the step of:

(L) applying said individual torn pieces in such edge-overlapping relationship as to establish a faux finish.

24. Interior decorating material comprising:

a substantially planar substrate having a pair of opposed surfaces;

one of such pair of surfaces having a preprinted pattern, said preprinted pattern being created from a latex binder and at least one insoluble pigment;

said remaining surface of such pair having a moisture activated prepaste; and, wherein said substrate is capable of being hand-tom into individual randomly-shaped and sized pieces; and sized pieces;

wherein at least a peripheral portion of each of said pieces has a ragged edge; and, wherein said latex binder and said at least one insoluble pigment is adapted to enable said pieces to overlap without detriment to overlapping edge adhesion.

25. The interior decorating material of claim 24, wherein said pair of opposed surfaces has a weight of about 0.5 to about 0.75 ounces per square foot.

26. The interior decorating material of claim 25, wherein said preprinted pattern is selected from the group consisting of:

(1) a chromatic presentation, (2) a randomly-presented motif, and (3) combinations of 1 and 2.

27. The interior decorating material of claim 25, wherein said pieces are adapted to be placed on said extended surface area to create a faux finish, free of plumb line orientation and pattern matching.

* * * * *